US006294769B1

(12) United States Patent
McCarter

(10) Patent No.: US 6,294,769 B1
(45) **Date of Patent: *Sep. 25, 2001**

(54) INFRARED FOOD WARMING DEVICE

(76) Inventor: David McCarter, 4563 Highway. 57, West, Ramer, TN (US) 38367

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/310,713

(22) Filed: May 12, 1999

(51) Int. Cl.[7] ..... H05B 3/44

(52) U.S. Cl. ..... 219/544; 219/411; 219/521; 392/435

(58) Field of Search ..... 219/209, 210, 219/211, 212, 443.1, 468.1, 520, 523, 528, 529, 540, 541, 544, 545, 549, 553, 385, 386, 387, 411, 521; 392/407, 432, 435

(56) References Cited

U.S. PATENT DOCUMENTS 3,809,859 * 5/1974 Wells ..... 392/435
3,878,361 * 4/1975 Levin et al. ..... 219/385
4,017,967 * 4/1977 Wells et al. ..... 392/435
4,060,710 * 11/1977 Reuter et al. ..... 392/435
4,272,673 * 6/1981 Semanaz et al. ..... 219/544
4,480,175 * 10/1984 Brasky ..... 392/435
4,542,282 * 9/1985 Brasky ..... 392/435
4,564,745 * 1/1986 Deschenes ..... 392/435
4,659,906 * 4/1987 Furtek ..... 219/553
4,728,780 * 3/1988 Uchino ..... 392/435
4,990,755 * 2/1991 Nishimura ..... 219/553
5,058,196 * 10/1991 Nakamura et al. ..... 392/435
5,128,514 * 7/1992 Lehmann et al. ..... 219/209
5,138,133 * 8/1992 Sakurada et al. ..... 219/528
5,679,277 * 10/1997 Niibe et al. ..... 219/545
6,075,230 * 6/2000 Wilson ..... 219/544

* cited by examiner

*Primary Examiner*—Teresa Walberg
*Assistant Examiner*—Fadi H. Dahbour
(74) *Attorney, Agent, or Firm*—James W. Kayden; Thomas, Kayden, Horstemeyer & Risley

(57) ABSTRACT

A device for maintaining food at a temperature within a selected range is disclosed, the device having a ceramic heating element with an electric element and a thermocouple contained therein. The device is maintained between approximately 200° F. and 650° F. and emits for infrared radiation within the range of approximately 7.91 to 4.7 microns.

10 Claims, 3 Drawing Sheets

INFRARED FOOD WARMING DEVICE

BACKGROUND OF THE INVENTION

Many restaurants, and, in particular fast food restaurants, prepare food ahead of its being ordered. This provides the ability to speed the delivery of the food to the customer and to perhaps utilize the cooking appliances for other food items. Certain parts of a meal and, in some cases, entire meals, are prepared in this manner, depending on the restaurant, the time of day, and the food itself.

With regard to the food, some dishes or food items are regularly prepared ahead of time and are sold at a rapid pace throughout the operating hours of the restaurant. One good example of such a food item is the french fries sold by numerous fast food restaurants. The fries are prepared in large batches and are then held in receiving bins prior to being packaged in small containers for sale to consumers.

While being held in the receiving bins, the french fries or other food items are normally kept at whatever serving temperature is deemed appropriate by the particular restaurant. While this temperature will vary depending on the food and the restaurant, it can be generally stated that the food is being kept hot prior to its eventual sale.

There are several disadvantages to the above described practice. For certain foods, the heating or warming process continues the cooking process. The food may thus become overcooked, making its taste, texture, or both, unacceptable. Lowering the temperature may have the same effect on the taste and texture, i.e. it becomes unacceptable. In addition, a lowered temperature often results in the food being cooled below the optimum serving temperature. In order to avoid such problems, many restaurants simply discard food after a certain defined period of time spent in a warming bin or tray. Alternatively, the food may be served or sold at a less than optimum serving temperature, resulting in the food being returned or if consumed, resulting in dissatisfaction of the customer with the restaurant.

Prior art devices of which the applicant is aware are limited to devices used for cooking as opposed to keeping food hot after cooking. For example, U.S. Pat. No. 5,421,942 to Hanzawa et al teaches a device for radiating far infrared radiation in the range of wavelengths of about 4 to 12 microns and higher. Example 7 in this patent teaches the use of the device in cooking, but does not mention the maintenance of temperature over time. U.S. Pat. No. 5,508,495 and U.S. Pat. No. 5,221,829, both to Yahav et al, disclose cooking devices having high thermal shock resistance so as to achieve temperatures of at least 200° C. and up to or exceeding 600° C. As can be seen, these patents do not teach a device that is capable of keeping food hot without continuing the cooking process.

Thus it can be seen that a need exists in the art for a food warming device that maintains food at a substantially constant optimum serving temperature or within an acceptable temperature range and which avoids the disadvantages of the prior art.

SUMMARY OF THE INVENTION

It is, therefore, one if the principal objects of the present invention to provide the ability to maintain a selected food item or items at a selected temperature or within an acceptable temperature range.

Another object of the present invention is to maintain food items at a selected serving temperature or within a selected temperature range for a greater period of time than prior art devices.

A further object of the present invention is to provide a food warming device that is easily constructed and maintained and which is durable to provide a long service life.

These and other objects are attained by the present invention which relates to a food warming device that emits infrared radiation for keeping food at a selected temperature or within a selected temperature range. The device emits infrared radiation at wavelengths between approximately 7.91 to 4.7 microns. The device itself is normally a formed ceramic material with an electric heating element contained therein. A thermocouple is used to control the temperature of the heating element. The temperature range of the element is normally maintained between approximately 200° F. to 650° F. At a temperature within this approximate range, the ceramic emits a micron wavelength, far infrared, within the range specified hereinabove. The ceramic material may have a contoured surface so as to distribute the infrared rays over a larger area.

Various additional objects and advantages of the present invention will become apparent from the following detailed description, with reference to the accompanying drawings.

DETAILED DESCRIPTION OF THE PREFERRED EMBODIMENT

Many people associate infrared with heat, but do not realize or even understand the importance of the specific wavelength pattern related to a given temperature of a specific radiant heater. Infrared theory is that the intermediate heating of the air between the heat source and the product is not required.

Temperature is related to the electromagnetic energy possessed by any given body or, in lay terms, the intensity of the heat. Everything that has a measurable temperature "emits" energy. In theory, a "Black body" emits 100% of all energy emitted to it. Therefore, all mass is relative to 1.0 or 100% emissivity. The emissivity of the body in question is measured in accordance with Kirkoff's Radiation Law.

$$\frac{\text{Emission of the given body}}{\text{Emission of the Black body}}$$

Radiant energy emitted in a continuous and constant wavelength is measured in "microns". All mass, which receives radiant energy, absorbs or emits the energy in a manner that is directly proportional to the "emissivity" of the product being heated.

In most heating applications, a radiant heat fixture can heat a material from ambient temperature to 160 deg F in up to one-eighth the time required in a conventional heating system. In a well designed radiant heating, system properly selected electromagnetic wavelengths (microns) penetrate below the surface being heated. This increases the motion of the energy between the molecules more uniformly throughout the entire thickness of the product. Any increase in the kinetic energy causes a temperature rise in the product.

A conventional hot air oven applies heat to the surface of the product. Therefore, all the heating is convection. By using this method, several problems can arise. The outside surface is not being warmed, it is being cooked and dried. Radiant heat eliminates this problem and greatly enhances the overall quality of the product.

Proper selection of a radiant heat source is critical in food applications to insure maximum holding time without affecting the quality or the texture of the product. The present radiant-element is a design not found in any working application to date and is 40% more efficient than food warming bulbs in achieving this goal.

| Type of Element | Radiant Efficiency % | Convection (cooking) % |
|---|---|---|
| Small diameter coiled Nichrome wire | 16–18 | 82–84 |
| Tubular rods (oven elements) | 42 | 58 |
| Quartz lamps (bulb style) | 55 | 45 |
| Present invention | 95 | 5 |

The larger the radiant percentage the more efficient the element is at keeping the product warmer longer. The lower the convection percentage the least amount of cooking taking place, therefore maintaining product quality and texture.

Figure 1:
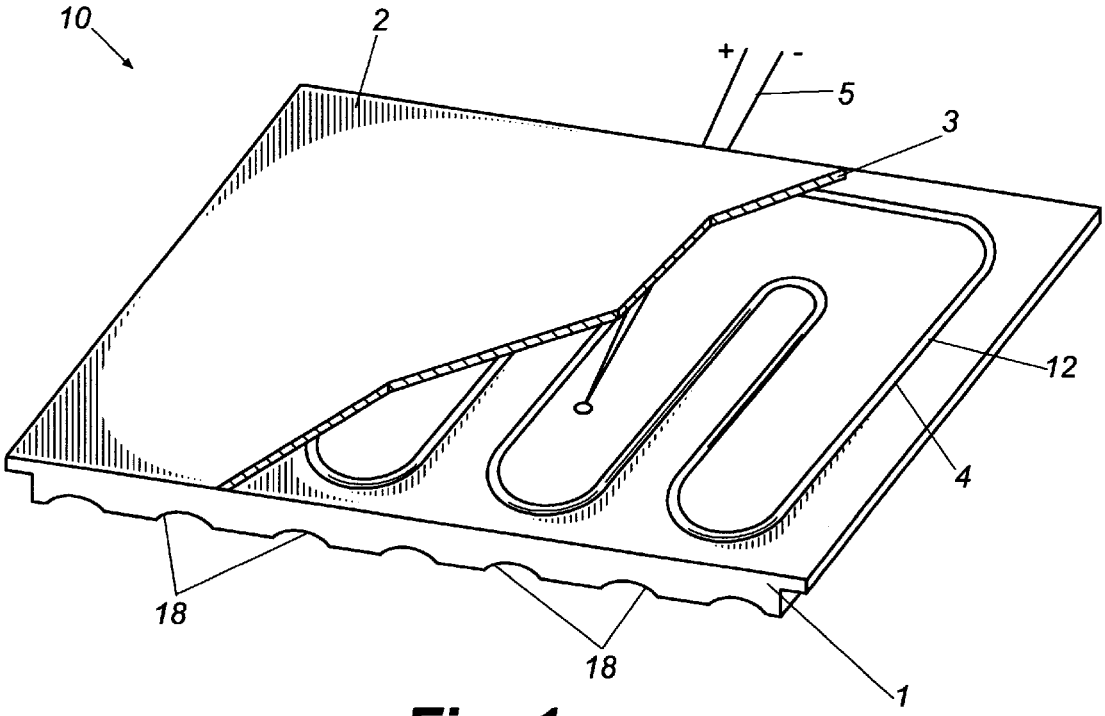
FIG. 1 is a partial perspective view showing the present heater, with a portion of the ceramic material cut away to show the interior thereof.

Referring now more specifically to the drawings, and to FIG. 1 in particular, numeral 10 designates generally a formed ceramic infrared electric heater. An electric sheathed heating element 12 is totally and permanently embedded in the ceramic. The ceramic also has a type "J", iron-constantan, thermocouple 14 permanently embedded therein. At a pre-determined temperature, the ceramic will emit an exact micron wavelength, in the far infrared range. By emitting an exact micron wavelength, the present invention warms food without additional cooking.

The infrared emitter of the present invention emits far infrared rays with the chosen wavelengths between approximately 7.91 to 4.7 microns. The rays with these wavelengths are emitted when the temperature of the element is maintained within the range of approximately 200° F. to 650° F. The wavelengths chosen are used very efficiently in maintaining the food at a selected temperature without further cooking of the food.

Figure 2:
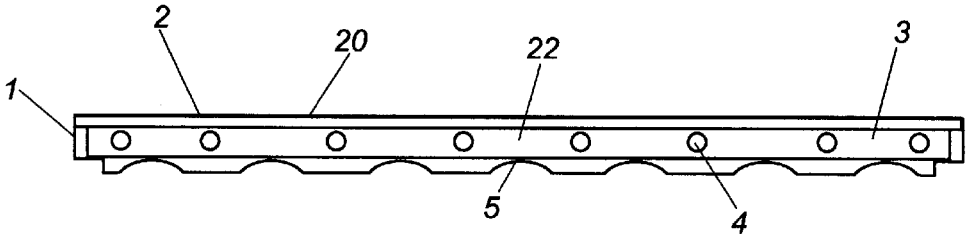
FIG. 2 is a cross-sectional view of the present heater, the section being taken along line 2—2 of FIG. 1.

I have found that a solid, ceramic device maintained at a pre-determined temperature setting will keep prepared food at a suitable temperature and does not appreciably affect the texture of the prepared food. It has been determined through extensive testing that this ceramic infrared element produces 96% efficient far infrared rays when controlled at the proper temperature using the type "J" iron-constantan thermocouple as a monitor of the temperature. As shown in FIGS. 1 and 2, the ceramic has a concave design on its lower surface 18. The concave design allows the infrared rays to be emitted over a larger area because microns travel in straight lines. This facilitates the use of the present invention when mounted over a food holding bin or tray, enabling the user to warm a relatively large quantity of food. It has been discovered that the present invention warms food with virtually no cooking, and therefore has the ability to maintain a serviceable product for three to four times as long or longer than presently used devices.

The device is constructed as solid ceramic fixture and, as shown in FIG. 2, has a solid ceramic top 20 that is permanently sealed using a Sauerisen high temperature cement rated for 3,000° F. Numeral 22 designates a half inch high temperature insulation layer directing the heat from the electric element 12 to the bottom 18 of the ceramic heating element or fixture.

The ceramic can be made using $Al_2O_3$,$TiO_2Cr_2O_3$, Mg0, $Zr0_2$, $Si0_2$, and the like. The tubular heating element is sheathed and is permanently embedded in the ceramic along with the thermocouple 14. The thermocouple is also permanently sealed in the ceramic and is an important element in regulating the temperature of the heating element.

Figure 3:
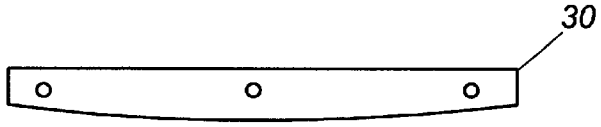
FIGS. 3–5 are partial, cross-sectional views showing alternate embodiments of the present invention.
Figure 4:
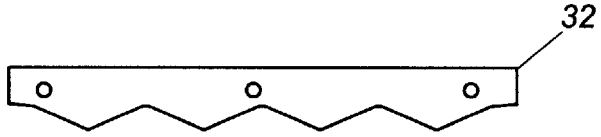
Figure 5:
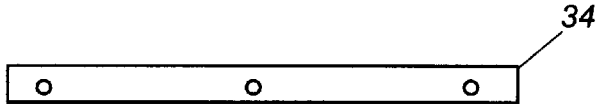

The bottom surface 18 of the ceramic is shown as having a concave design in order to emit the infrared rays over a larger area. As shown in FIGS. 3 through 5, various additional contours or configurations may be utilized. These include convex 30, faceted 32, and also substantially linear configurations 34, respectively. Combinations of these shapes may also be used in order to effectively increase the surface area of the ceramic and emit the infrared rays over a greater area. In all of these designs, the element temperature is maintained between approximately 200° F. and 650° F. in order to emit far infrared rays with wavelengths between approximately 7.91 to 4.7 microns.

The present device is typically powered with either a 120 or 240 volt AC circuit and is turned on and off with a simple toggle switch or the like (not shown). The temperature settings are adjusted at the factory and need not be adjusted once the unit is in place in a restaurant or other establishment. The ceramic element is normally mounted in a stainless steel hood over the prepared food. The element is secured therein in any known manner. Generally speaking, the expected life of ceramic heaters is 10,000 hours with the unit running at 1400° F. The present unit is designed to operate at a maximum temperature of approximately 650° F. which provides a significantly longer lifespan, on the order of 20,000 to 25,000 hours. As stated hereinabove, temperature adjustments can be made internally at the factory. Afterwards, no adjustment can or need be made in the field. The temperature and wavelength settings are set relatively exactly for the desired food to be warmed, eliminating the need for most, if not all, adjustments.

As an example of the use and operation present invention, the ceramic element was set to operate at 525° F. At this temperature, far infrared rays are emitted with wavelengths of around 5.3 microns. When mounted at 18 inches above the prepared, i.e. cooked, french fries, the present device will maintain the temperature of the fries at above approximately 145° F. for at least 30 minutes. This temperature maintains the food at a suitable serving temperature without further cooking of the food or a change in the texture of the food.

Figure 7:
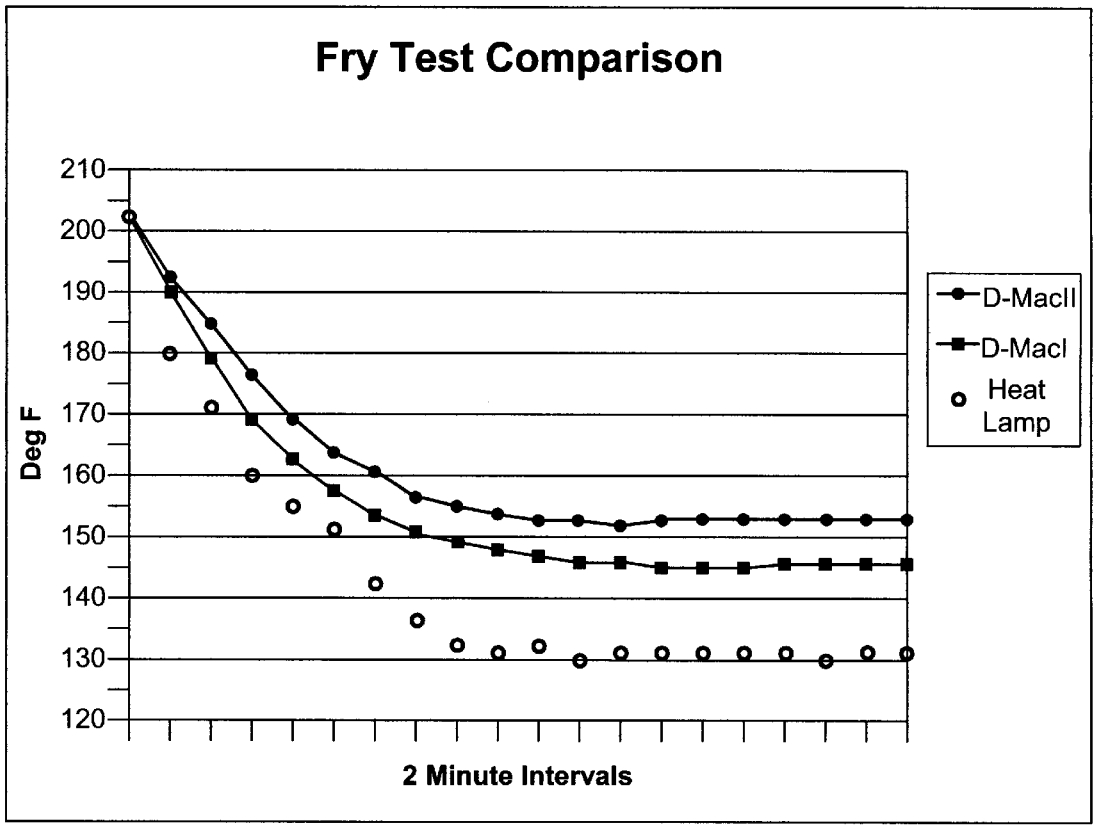
FIG. 7 is a graph showing the results of a fry test comparison.

Referring now to FIG. 7, results from a french fry test are shown. In the test, the present invention (the "D-Mac I" and "D-Mac II"), was compared to the conventional heat lamp used at many fast food restaurants, such as McDonald's®. The setup procedures included: "D-Mac" element and control, shoestring fries, distance to product (18"sloping to 22"), reflective surfaces (mirror and stainless steel), physical structure arranged to stimulate McDonald's® fry station, all temperature readings taken internally, sensor-Special limits type "J" thermocouple (0.040 dia.304SS), and indicator-West Model 6100 indicator with 0.25% accuracy (span 32 to 250 deg F). The results from the heat lamp plot were taken from McDonald's® fry station. As one can see from the graph, the stabilization of the "D-Mac II" was at 153 degrees, stabilization of the "D-Mac I" was at 146 degrees, and stabilization of the heat lamp was at 131 degrees.

In another test, with the element temperature set at approximately 450° F., the ceramic element emits far infrared rays at a wavelength of approximately 5.7 microns. Hamburgers dressed with tomatoes, lettuce, pickles, etc. were placed approximately 18 inches below the element. The hamburgers themselves were maintained at a temperature of approximately 150° F. for at least 30 minutes without any noticeable effect on the tomato, lettuce, pickles, etc., and without further cooking the meat.

Figure 6:
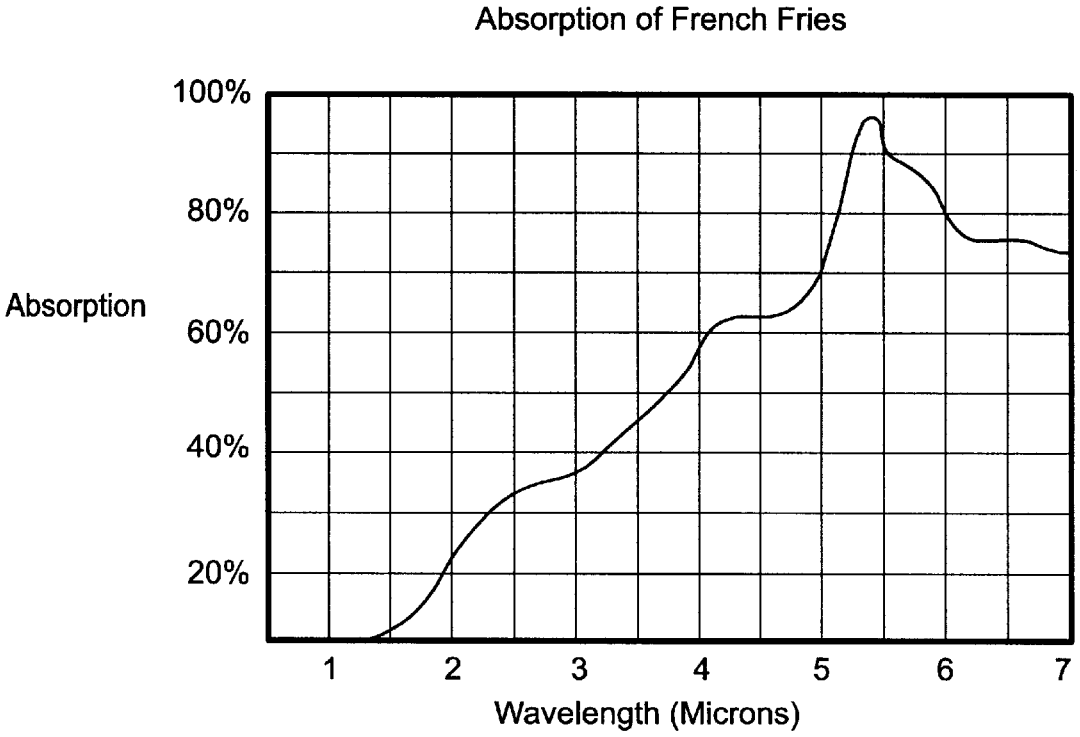
FIG. 6 is a graph showing absorption of infrared radiation by french fries.

FIG. 6 illustrates a plot of the absorption of infrared radiation for french fries. As can easily be seen and appreciated, optimum absorption occurs at approximately 5.3 microns. Values on either side of this wavelength, within obvious limits as shown on the graph, are also acceptable for keeping this particular product at an acceptable serving temperature.

While an embodiment and modifications of an infrared food warming device have been shown and described in detain herein, various additional changes and modifications may be made without departing from the scope of the present invention.

I claim:

1. A warming device for use in keeping food at a relatively constant serving temperature without further cooking the food comprising:

a ceramic heating element emitting far infrared rays having a wavelength within the range of approximately 7.91 to 4.7 microns;

an electric tubular heating element embedded in the ceramic heating element; and a thermocouple, embedded in the ceramic heating element, and wherein the ceramic heating element forms a housing structure.

2. A warming device as defined in claim 1 in which said electrical tubular heating element is normally maintained between approximately 200° F. to 650° F.

3. A warming device as defined in claim 2 in which said thermocouple controls the temperature of said electrical tubular element.

4. A warming device as defined in claim 1 in which said electric tubular heating element is permanently embedded in the ceramic heating element and said thermocouple regulates the temperature of said ceramic heating element.

5. A warming device as defined in claim 1 in which said ceramic heating element is a formed ceramic.

6. A warming device as defined in claim 5 which said ceramic heating element has a contoured outer surface.

7. A warming device as defined in claim 1 in which said ceramic heating element has a contoured outer surface.

8. A warming device as defined in claim 1 in which said ceramic heating element has a substantially flat surface.

9. An apparatus for maintaining food within a selected temperature range, said apparatus being supported by a ceramic support structure and receiving power from a power source, the apparatus comprising:

a ceramic heating element;

an electric tubular heating element contained in the ceramic heating element; and a thermocouple contained in the ceramic heating element, wherein said ceramic heating element emits far infrared radiation within the range of 7.91 to 4.7 microns.

10. An apparatus as defined in claim 9 in which said ceramic heating element is maintained within a temperature range of 200° F. to 650° F.

* * * * *

UNITED STATES PATENT AND TRADEMARK OFFICE

CERTIFICATE OF CORRECTION

PATENT NO. : 6,294,769 B1
DATED : September 25, 2001
INVENTOR(S) : McCarter

It is certified that error appears in the above-identified patent and that said Letters Patent is hereby corrected as shown below:

Drawings,

Sheet 1, Fig. 1, delete the reference numeral “2” and replace with reference numeral -- 20 --.
The reference numeral 14 should be applied to the thermocouple embedded in the ceramic heater 10.
Delete reference numeral “5” and its leader.
Delete reference numeral “4” and its leader.
Delete reference numeral “3” and its leader.
Delete reference numeral “1” and its leader.

Sheet 1, Fig. 2, delete reference numerals “1”, “2”, “3” and “5”, and their leaders.
Delete reference numeral “4” and replace with reference number -- 12 --.

Signed and Sealed this

Eleventh Day of June, 2002

*Attest:*

*Attesting Officer*

JAMES E. ROGAN
*Director of the United States Patent and Trademark Office*